US005683168A

United States Patent [19]

Teig et al.

[11] Patent Number: 5,683,168

[45] Date of Patent: Nov. 4, 1997

[54] SPRAY CANISTER LIGHT

[76] Inventors: Willard H. Teig, 4820 Columbia Heights Rd.; Randy S. Teig, 2637 Maplewood Dr., both of Longview, Wash. 98632

[21] Appl. No.: 712,857

[22] Filed: Sep. 11, 1996

[51] Int. Cl.[6] ..... F21V 33/00

[52] U.S. Cl. ..... 362/96; 362/234; 222/113

[58] Field of Search ..... 362/96, 101, 102, 362/234, 253; 222/113

[56] References Cited

U.S. PATENT DOCUMENTS

| | | | |
|---|---|---|---|
| 2,625,764 | 1/1953 | O'Brien et al. | 42/1.08 X |
| 2,855,497 | 10/1958 | Bacon . | |
| 3,638,836 | 2/1972 | Vickers, III | 362/96 X |
| 3,716,170 | 2/1973 | Mangels | 222/162 |
| 3,776,429 | 12/1973 | DeLucia | 222/162 |
| 4,186,851 | 2/1980 | Cantor | 222/113 |
| 4,223,804 | 9/1980 | Morris et al. | 222/3 |
| 4,247,844 | 1/1981 | Zapolski et al. | 340/321 |
| 4,434,914 | 3/1984 | Meshberg | 222/153 |
| 4,449,474 | 5/1984 | Mariol | 116/2 |
| 5,086,377 | 2/1992 | Roberts | 362/96 X |
| 5,197,734 | 3/1993 | Ashihara | 273/84 R |
| 5,307,249 | 4/1994 | Vanwynsberghe | 362/96 |
| 5,373,427 | 12/1994 | McLean | 362/96 |
| 5,446,985 | 9/1995 | Chen | 362/96 X |

*Primary Examiner*—Stephen F. Husar
*Attorney, Agent, or Firm*—Dellett and Walters

[57] ABSTRACT

An improved spray canister light comprising a lens cap threadably secured to a light head cap, the light head cap threadably secured to a battery body containing batteries therein. The spray canister light further comprising a canister body threadably secured to the battery body and environmentally sealed therefrom, the canister body including a replaceable canister and a depressible spray nozzle therein. An on/off push action switch contained within the body may be depressed so as to activate the light whereas the depressible spray nozzle within the canister portion may be depressed so as to discharge from the spray canister light the contents of the canister. In the preferred embodiment, the on/off switch and the depressible spray nozzle are recessed with respect to an outer surface of the device thereby ensuring the switch and the nozzle may not inadvertently be activated or broken.

18 Claims, 2 Drawing Sheets

SPRAY CANISTER LIGHT

The present invention relates to an improved spray canister light, and more particularly, to an improved spray canister light that includes a spray canister and a flashlight in a single structure thereby allowing one-handed operation. The improved spray canister light environmentally seals the light structure away from the canister structure so as to prevent corrosive interaction therebetween and so as to provide a structurally sturdy device that is not easily damaged.

BACKGROUND OF THE INVENTION

Flashlights are self-contained portable devices used to illuminate darkened areas and powered by self-contained batteries. Spray canisters are self-contained portable devices used to spray a caustic spray, such as powdered cayenne pepper, to ward off an attacker.

Heretofore, law enforcement officials and persons desiring personal safety often carried both a flashlight and a spray canister device. Simultaneous use of both a conventional flashlight and a conventional spray canister device, accordingly, required two-handed operation. Attempted combination of spray canisters and flashlights within a single structure has resulted in contamination of the spray canister by battery leakage and has resulted in a structurally fragile device wherein the spray canister nozzle may be easily damaged.

SUMMARY OF THE INVENTION

Accordingly, an object of the present invention is to provide an improved spray canister light that includes a spray canister and a lighting device within a single structure.

Another object of the present invention is to provide an improved spray canister light that allows one-handed manual operation.

Yet another object of the present invention is to provide an improved spray canister light that environmentally seals the spray canister from the batteries of the lighting device.

Still another object of the present invention is to provide an improved spray canister light that is sturdy in construction.

Accordingly, the present invention provides an improved spray canister light including a spray canister and a lighting device within a single structure that allows for one-handed manual operation. Additionally, the present invention provides an improved spray canister light that environmentally seals the spray canister away from the batteries of the lighting device and is sturdy in construction.

In a preferred embodiment, the improved spray canister light comprises a lens cap threadably secured to a head portion, the head portion being threadably secured to a body portion containing batteries therein. The spray canister light further comprises a canister portion threadably secured to the body portion and environmentally sealed therefrom, the canister portion including a canister and a depressible spray nozzle therein. An on/off toggle switch contained within the body may be depressed so as to activate the light whereas the depressible spray nozzle within the canister portion may be depressed so as to discharge from the improved spray canister light the contents of the spray canister. In the preferred embodiment, the on/off switch and the depressible spray nozzle are positioned such that the switch and the nozzle are recessed within the spray canister device with respect to an outer surface of the device thereby guarding against inadvertent activation or breakage of the components.

In another embodiment, the improved spray canister light comprises an elongate tube including a sealing wall located centrally therein so as to define a battery cavity and a spray canister cavity environmentally sealed from each other. The batteries are secured within the battery cavity by a lens cap and a canister is secured within the canister cavity by an end cap including a nozzle therein.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE INVENTION

DETAILED DESCRIPTION

Figure 1:
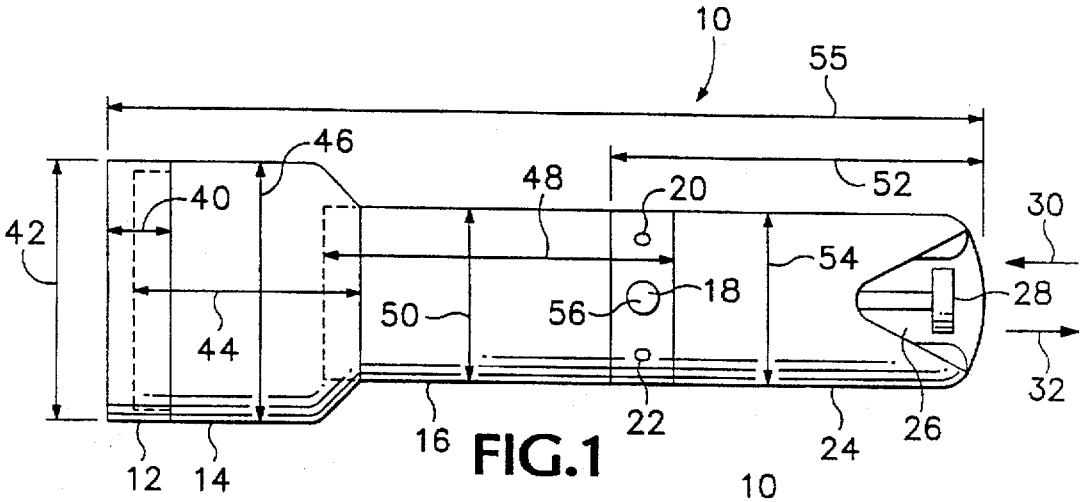
FIG. 1 is a left side elevational view of the spray canister light of the present invention showing the on/off switch and the depressible spray nozzle.

Referring to FIG. 1, which is a left side elevational view of the spray canister light of the present invention showing the on/off switch and the depressible spray nozzle, the present invention comprises an improved spray canister light 10 including a lens cap 12 attached to a light head cap 14 which is in turn attached to a light battery body 16. Light battery body 16 includes a push action on/off switch 18 and recharge pads 20 and 22. Battery body 16 is connected to a canister body 24 which includes a thumb aperture 26 and a depressible spray nozzle 28 positioned therein and being movable in directions 30 and 32.

In the preferred embodiment, lens cap 12 has a width 40 of approximately 0.5 inches and a diameter 42 of approximately 2.5 inches. Light head cap 14 has a width 44 of approximately 2.25 inches and a diameter 46 of approximately 2.5 inches. Battery body 16 has a length 48 of approximately 3 to 5 inches and a diameter 50 of approximately 1.7 inches. Canister body 24 has a length 52 of approximately 2 to 4 inches and a diameter 54 of approximately 1.7 inches. Accordingly, light 10 may have a total length 55 in the range of approximately 5 to 10 inches. In the preferred embodiment, lens cap 12, light head cap 14, battery body 16 and canister body 24 are manufactured of black anodized aluminum for durability and corrosion resistance. In other embodiments, these components may be manufactured of stainless steel, engineered plastic or other such like material.

Switch 18 preferably is a momentary snap action on/off switch encased within a plastic cover 56 so as to environmentally isolate switch 18 from external environmental conditions. Switch 18 is recessed with respect to a surface of the light so that the switch is not inadvertently activated.

Recharge pads 20 and 22 preferably are manufactured of brass so as to facilitate good electrical contact with the batteries when they are being recharged. Nozzle 28 preferably is manufactured of engineered plastic such as nylon but may also be manufactured of stainless steel, aluminum or the like.

Figure 2:
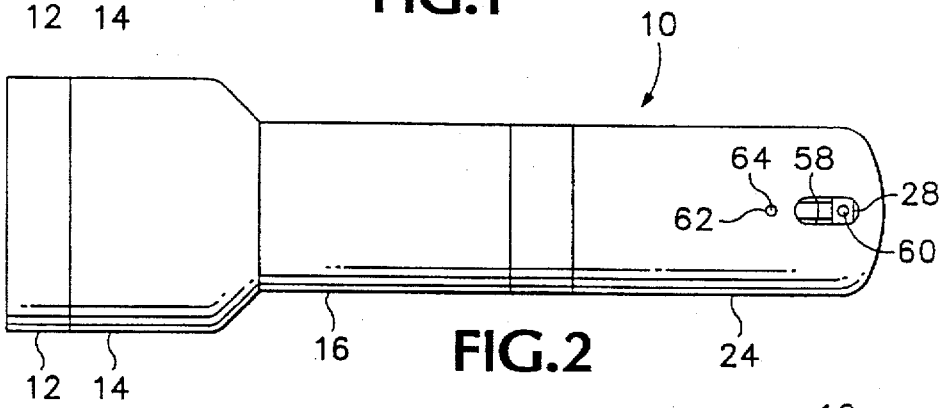
FIG. 2 is a right side elevational view of the spray canister light of the present invention showing the outlet of the depressible spray nozzle.

Referring now to FIG. 2, which is a right side elevational view of the spray canister light of the present invention showing the outlet of the depressible spray nozzle, canister body 24 includes an aperture 58 aligned with an aperture 60 of depressible spray nozzle 28 such that upon depression of nozzle 28, the contents of the spray canister are discharged through aperture 60 and thereafter through aperture 58 in canister body 24. Canister body 24 further comprises an aperture 62 for receiving therein a set screw 64 to prevent loss of depressible spray nozzle 28.

Figure 3:
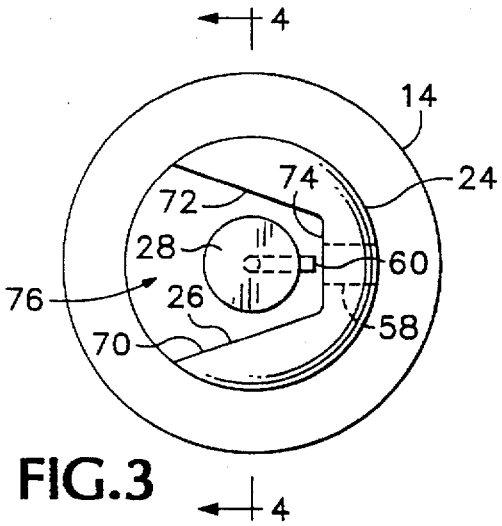
FIG. 3 is a bottom end view of the spray canister light showing the depressible spray nozzle.

Referring now to FIG. 3, which is a bottom end view of the spray canister light showing the depressible spray nozzle, thumb aperture 26 comprises tapered side walls 70 and 72 and a generally straight rear wall 74. In other embodiments, thumb aperture 26 may comprise a generally rounded opening having a curved rear wall. The tapered opening as shown, however, is less expensive to manufacture than is a curved wall. Thumb aperture 26 further comprises an open end 76 adapted so as to receive the thumb of a user. Open end 76 preferably is positioned opposite nozzle aperture 60 within nozzle 28 which is aligned with aperture 58 within canister body 24.

Figure 4:
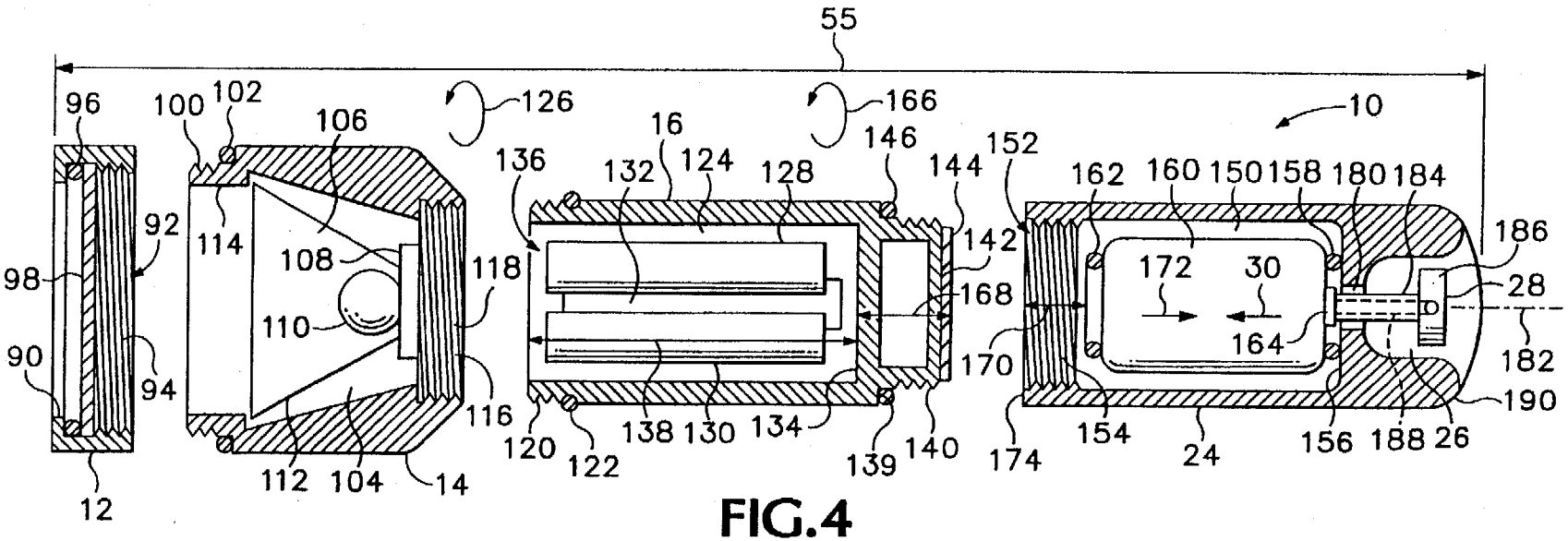
FIG. 4 is an exploded partial cross sectional left side view of the spray canister light showing the internal components.

Referring now to FIG. 4, which is an exploded partial cross sectional left side view of the spray canister light showing the internal components, lens cap 12 includes an aperture 90 and a cavity 92 having threads 94 therein. Lens cap 12 further includes an O-ring 96 positioned adjacent aperture 90 and within cavity 92 and a lens 98 positioned adjacent the O-ring. Lens 98 preferably is manufactured of a transparent plastic, but may also be manufactured of glass or like material. O-ring 96 preferably is manufactured of rubber but may also be manufactured of any flexible material that is relatively impervious to external environmental conditions.

Still referring to FIG. 4, light head cap 14 comprises threads 100 and an O-ring 102 positioned thereon so as to engage threads 94 and cavity 92 of lens cap 12 thereby creating an environmental seal when the components are secured together. Light head cap 14 further comprises a cavity 104 having a light fixture 106 positioned therein. Light fixture 106 includes a flange mount 108, a bulb 110 and a conical reflector 112, as known in the art. Reflector 112 is positioned adjacent an aperture 114 such that light from bulb 110 is reflected through aperture 114, through lens 98, and thereafter outwardly of spray canister light 10. Light head cap 14 further comprises a flange aperture 116 including threads 118 therein, aperture 116 being sized so as to enable positioning of flange mount 108 therein.

Battery body 16 includes threads 120, an O-ring 122 and an internal cavity 124. Threads 120 and O-ring 122 are sized to engage threads 118 such that light head cap 14 may be secured to battery body 16 by rotational movement of head cap 14 in a direction 126. Such movement of light head cap 14 in direction 126 causes O-ring 122 to engage threads 118 thereby creating an impervious seal so as to environmentally seal internal cavity 124. Cavity 124 preferably is sized to receive three batteries 128, 130 and 132 therein, the batteries typically comprising rechargeable batteries, e.g., nickel cadmium "4/5 A-size" battery cells. In other embodiments, cavity 124 may contain any number of batteries in a variety of configurations as is known in the art.

Cavity 124 further includes a rear wall 134 positioned opposite an opening 136 and a length 138 of approximately 2.5 to 4.5 inches. Accordingly, upon rotational movement of light head cap 14 in direction 126, cavity 124 is sealed from external environmental conditions, and batteries 128, 130 and 132 are forced against rear wall 134 such that an opposite end of the batteries contact flange mount 108 of light fixture 106. In this manner, the batteries are electrically connected to light fixture 106.

In the preferred embodiment, switch 18, batteries 128, 130 and 132, and light fixture 106 are wired together as known in the art. Specifically, the circuit includes a wire (not shown) extending from the batteries to switch 18, and a wire extending from a first side of the charge pads to switch 18. The circuit also includes a wire extending from switch 18 to light bulb 110 and a wire extending from a second side of the charge pads to bulb 110, as known in the art. In another embodiment, the switch may be removed from the recharge pad circuit so as to reduce heating of the switch during recharging. Moreover, in still another embodiment, the batteries may be directly connected to flange mount 108, without the use of wires, by rotation of light head cap 14 in direction 126, as known in the art. Other wiring configurations as known in the industry may also be used.

Still referring to FIG. 4, battery body 16 further comprises a shoulder 139 and threads 140 positioned adjacent to rear wall 134. Threads 140 terminate in a solid end region 142 of body 16 which preferably has a flexible pad 144 positioned thereon. In the preferred embodiment, an O-ring 146 is positioned adjacent to shoulder 139.

Canister body 24 preferably comprises an internal cavity 150 having an open end 152 with threads 154 therein. Cavity 150 further comprises a rear wall 156, an O-ring 158 positioned against the rear wall, a replaceable canister 160 held within the cavity, and an O-ring 162 positioned in open end 152 and adjacent canister 160. Canister 160 includes a canister nozzle 164 positioned adjacent depressible spray nozzle 28. In the preferred embodiment, threads 154 are sized to receive therein threads 140 and O-ring 146 such that as battery body 16 is rotated in a direction 166, battery body 16 is secured to canister body 24 thereby sealing cavity 150 from external environmental conditions. Moreover, threads 140 and 154 preferably have widths 168 and 170, respectively, of 0.5 inches so that, upon rotation of battery body 16 in direction 166, flexible pad 144 is forced against O-ring 162 thereby forcing canister 160 in a direction 172. Movement of canister 160 in direction 172 presses canister nozzle 164 into engagement with depressible spray nozzle 28 thereby facilitating discharge of the canister contents therethrough. In the preferred embodiment, canister 160 contains a powdered irritant such as powdered cayenne pepper. Canister body 24 further includes an end surface 174 which abuts shoulder 139 upon correct placement of canister 160 within cavity 150 and nozzle 164 against depressible spray nozzle 28. Accordingly, batteries 128, 130, and 132 are environmentally sealed away from canister 160 so as to prevent corrosion therebetween.

Still referring to FIG. 4, canister body 24 further comprises an elongate aperture 180 extending along an axis 182 of light 10 between thumb aperture 26 and canister nozzle 164. Nozzle 28 further comprises a neck region 184, an enlarged contact surface 186, and an internal spray passageway 188. Neck region 184 preferably is positioned within elongate aperture 180 and contact surface 186 preferably is positioned recessed within thumb aperture 26 and below an end surface 190 of canister body 24 such that if device 10 is dropped, nozzle 28 cannot be inadvertently depressed in direction 30. Purposeful manual depression of nozzle 28 in direction 30, however, permits the pressurized contents of canister 160 to be expelled through passageway 188 and outwardly toward a target.

Still referring to FIG. 4, the assembly of spray canister light 10 will be described. First, an operator places replaceable canister 160 within cavity 150 such that nozzle 164 is aligned with elongate aperture 180 within depressible spray nozzle 28. Canister 160 preferably is positioned between O-rings 158 and 162. Next, battery body 16 is rotated in direction 166 such that threads 154 and 140 mateably engage thereby securing battery body 16 to canister body 24. Body 16 is further rotated in direction 166 such that O-ring 146 seals cavity 150 and such that end surface 174 of canister body 24 abuts shoulder 139 of battery body 16. In this position, flexible pad 144 engages O-ring 162 thereby urging canister 160 in direction 172 such that nozzle 164 engages passageway 188 of depressible spray nozzle 28. In this manner, canister 160 is environmentally sealed within cavity 150 and spray nozzle 28 is operatively connected with the contents of canister 160 such that upon depression of contact surface 186 in direction 30, the contents of the canister will be discharged from the device.

Next, batteries 128, 130 and 132 are placed within cavity 124 in a proper predetermined alignment. Thereafter, light head cap 14 is rotated in direction 126 such that threads 120 and O-ring 122 engage threads 118 thereby securing light head cap 14 to battery body 16. In this manner, light fixture 106 contained within cavity 104 is forced in direction 172 such that flange mount 108 appropriately contacts the battery wiring circuit. Thereafter, lens 98 and O-ring 96 are positioned within lens cap 12, and lens cap 12 is rotated in direction 126 so as to secure the lens cap to threads 100 of light head cap 14. In the preferred embodiment, the diameters of the corresponding sets of mating threads are varied so as to ensure correct assembly of device 10.

Figure 5:
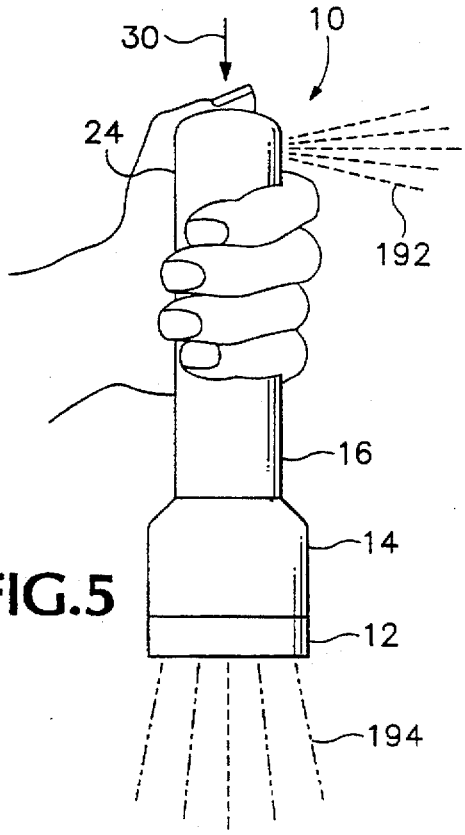
FIG. 5 is a side elevational view of the spray canister light in use.

Referring now to FIG. 5, which is a side elevational view of the spray canister light in use, operation of spray canister light 10 will be described. To operate the spray canister portion of device 10, an operator grasps battery body 16 and canister body 24 with a hand and positions a thumb within thumb aperture 26. Downward motion of the operator's thumb in direction 30 causes the pressurized contents of canister 160 to exit nozzle aperture 60 so as to create a stream of irritant material 192. The stream of irritants may be aimed in the direction of an attacker so as to dispel an attack.

To operate the light portion of device 10, the operator depresses on/off switch 18 (FIG. 1) so as to energize bulb 110 and create a light beam 194. Due to the sturdy compact design of device 10 wherein switch 18 and nozzle 28 are recessed with respect to an exterior surface of the light, an operator may use device 10 as a club without damaging the device. As shown in FIG. 5, and resulting from the compact efficient design of device 10, stream 192 and light beam 194 are positioned at opposite ends of the device. Spray canister light 10, therefore, does not include elaborate nozzles extending the length of the device or intricate wiring or tubing systems that may become damaged should device 10 be used as a club. Accordingly, there is described a compact, sturdy spray canister and light device which allows one-handed use by an operator.

Figure 6:
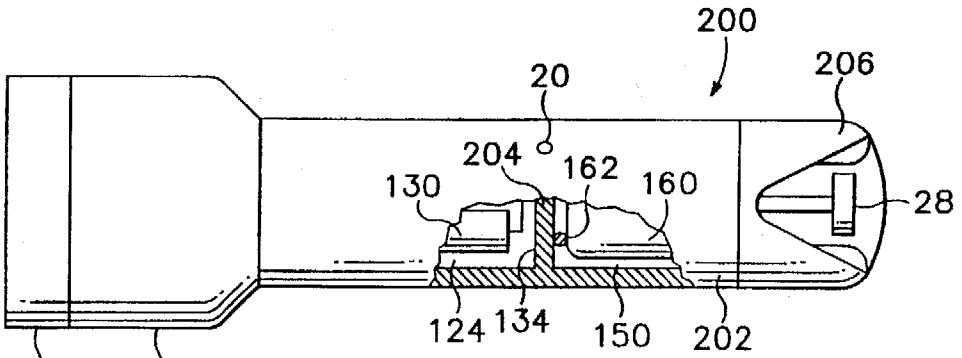
FIG. 6 is a partial cutaway side elevational view of another embodiment of the spray canister light.

Referring now to FIG. 6, which is a partial cutaway side elevational view of another embodiment of the spray canister light, spray canister light 200 comprises a central body 202 including a sealing wall 204, also known as a plug, located centrally therein. Sealing wall 204 defines internal cavity 124 containing therein batteries 128, 130 and 132, and internal cavity 150 containing therein replaceable canister 160. Accordingly, light head cap 14 iS threadably secured to central body 202 to secure the batteries therein, and a nozzle cap 206 is threadably secured to central body 202 to secure canister 160 therein and to seat nozzle 164 against depressible spray nozzle 28. This embodiment is sturdier in construction than 1s spray canister light 10 but is more difficult to manufacture due to the central location of sealing wall 204.

While plural embodiments of the present invention have been shown and described, it will be apparent to those skilled in the art that many changes and modifications may be made without departing from the invention in its broader aspects. The appended claims therefore are intended to cover all such changes and modifications as fall within the true spirit and scope of the invention.

What is claimed is:

1. A spray canister light comprising:

illumination means adapted for providing an illumination beam;

power means operatively connected to said illumination means to provide power thereto; and spray canister means including a removable canister, a recess, and an external, directly accessible nozzle movably secured within said recess and positioned to engagingly receive an end of said removable canister, said spray canister means being adapted for providing a spray of irritant material from said canister and through said nozzle when said canister is in an engaged position with the nozzle and when said nozzle is directly depressed within said recess along an elongate axis of the spray canister light; said spray canister means being environmentally sealed from said power means and operatively connected thereto so as to form an integral unit whereby said power means urges said canister into the engaged position.

2. A spray canister light according to claim 1 wherein said illumination means comprises a lens cap and a light head cap including a light bulb positioned therein.

3. A spray canister light according to claim 1 wherein said power means comprises a battery body including an internal chamber therein.

4. A spray canister light according to claim 3 wherein said power means further comprises at least one battery positioned within said internal chamber.

5. A spray canister light according to claim 1 wherein said spray canister means comprises a canister body including an internal cavity therein.

6. A spray canister light according to claim 5 wherein said canister is positioned within said internal cavity.

7. A spray canister light according to claim 1 wherein said power means comprises a battery body having a solid lower wall and wherein said spray canister means is attached to said solid lower wall, the solid lower wall environmentally sealing said power means from said spray canister means.

8. A spray canister light according to claim 7 wherein said solid lower wall urges said canister into the engaged position.

9. A spray canister light according to claim 1 wherein said nozzle is a depressible spray nozzle having an internal passageway through which passes the irritant meterial.

10. A spray canister light according to claim 9 wherein said depressible spray nozzle is recessed with respect to an exterior surface of said spray canister means whereby said depressible spray nozzle is protected from breakage.

11. A spray canister light according to claim 1 wherein said illumination means and said spray canister means are positioned opposite one another across said power means.

12. A spray canister light according to claim 1 wherein said integral unit comprises a power means cavity and a spray canister means cavity environmentally sealed from said power means cavity.

13. A spray light assembly comprising:

a canister body including an internal cavity, a spray canister removably positioned therein, a recess, and a depressible spray nozzle that is directly, externally accessible within said recess, said nozzle being adapted for engaging said spray canister and producing a spray of irritant material along a spray path when said nozzle is directly depressed within said recess along an elongate axis of the spray light assembly;

a battery body connected to said canister body and including an internal chamber, a battery positioned therein, and a rear wall; and a light head connected to said battery body and including a light fixture adapted for providing a light beam along a light path, said light head being environmentally sealed from said canister body by said battery body rear wall and said light path being generally non-aligned with said spray path.

14. A spray light assembly according to claim 13 wherein said rear wall is adapted for urging said spray canister into engagement with said spray nozzle.

15. A spray light assembly according to claim 13 wherein said depressible spray nozzle is recessed with respect to an exterior surface of said canister body whereby said depressible spray nozzle is protected from breakage.

16. A spray light assembly according to claim 13 wherein said battery body further comprises a switch that is recessed with respect to said exterior surface of said battery body whereby said switch is protected from breakage.

17. A spray light assembly according to claim 13 wherein said light head and said canister body are positioned opposite one another across said power means.

18. A spray light assembly according to claim 13 wherein said canister body and said battery body are manufactured as one elongate unit having a sealing wall positioned generally centrally therein.

* * * * *